US005974744A

United States Patent [19]

Guilbeault

[11] Patent Number: 5,974,744

[45] Date of Patent: Nov. 2, 1999

[54] COLUMN PROTECTOR APPARATUS

[76] Inventor: Robert H. Guilbeault, 64 Riverside Ave., Attleboro, Mass. 02703

[21] Appl. No.: 09/064,229

[22] Filed: Apr. 23, 1998

[51] Int. Cl.[6] ..... E04C 5/00

[52] U.S. Cl. ..... 52/170; 52/736.4; 52/737.5

[58] Field of Search ..... 52/169.13, 170, 52/736.4, 737.5, DIG. 8, 730.4, 731.2, 732.1, 734.2; 248/345.1; 256/1

[56] References Cited

U.S. PATENT DOCUMENTS

| | | | |
|---|---|---|---|
| 985,605 | 2/1911 | Kanopinski . | |
| 1,244,119 | 10/1917 | Mulnix et al. . | |
| 1,755,461 | 4/1930 | Spring | 52/170 |
| 1,979,580 | 11/1934 | Spring . | |
| 3,372,552 | 3/1968 | Liddell | 52/737.5 |
| 3,738,072 | 6/1973 | Adrian . | |
| 4,688,366 | 8/1987 | Schmidt | 52/732.1 |
| 4,854,107 | 8/1989 | Roberts | 52/731.7 |
| 5,014,487 | 5/1991 | King | 52/731.2 |
| 5,371,986 | 12/1994 | Guditis . | |
| 5,775,051 | 7/1998 | Nicolai et al. | 52/731.2 |

FOREIGN PATENT DOCUMENTS

| | | | |
|---|---|---|---|
| 2026418 | 12/1970 | Germany | 52/731.2 |
| 211628 | 12/1940 | Switzerland | 52/731.2 |

*Primary Examiner*—Michael Safavi

[57] ABSTRACT

A protector apparatus for a vertical structure includes a plurality of protector units for contacting the vertical structure, wherein each protector unit includes a structure-contacting portion, standoff portions projecting out from the structure-contacting portion, and a bumper portion supported by the standoff portions. Interconnectors are provided for connecting between the protector units for securing the protector units to each other and to the vertical structure. The interconnectors are connected between standoff portions of adjacent protector units. The standoff portions include bolt-reception channels, and the interconnectors include double-threaded-double-ended bolts. A single threaded end of each of the double-threaded-double-ended bolts is received in a bolt-reception channel, and the interconnectors include nuts secured to the single threaded bolt ends. When the nuts are tightened on the double-threaded-double-ended bolts, the protector units are connected tightly to each other. As a result, the protector units are secured to the column by virtue of the fact that the column is in effect tightly clamped between the protector units. In addition, the widths of the standoff portions provide a standoff distance which is greater than an outlet distance for an electrical outlet that may be located on the column. In this way, the electrical outlet is protected by the protector units.

11 Claims, 3 Drawing Sheets

FIG 3
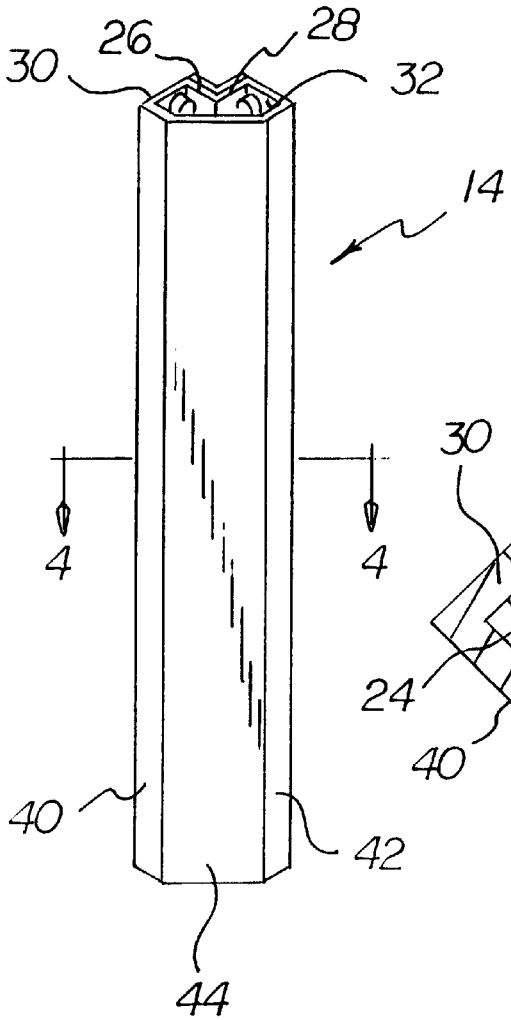
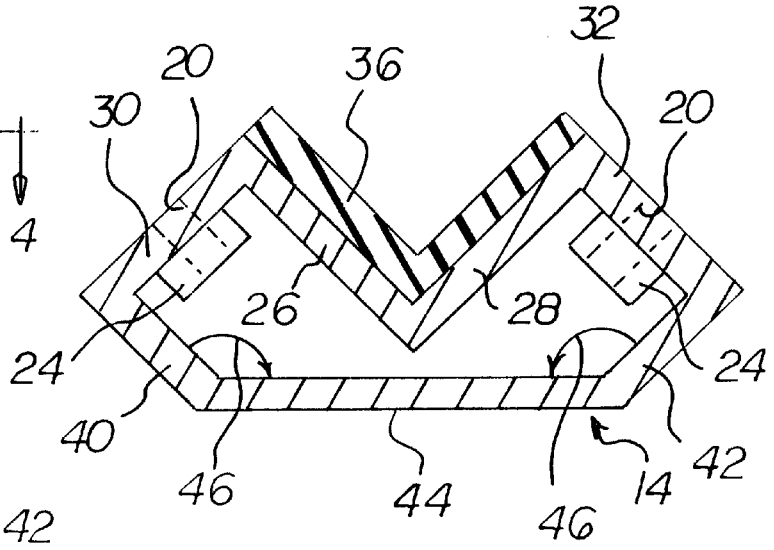
FIG 4

COLUMN PROTECTOR APPARATUS

BACKGROUND OF THE INVENTION

1. Field of the Invention

The present invention relates generally to protectors for protecting structures, and, more particularly, to devices especially adapted for protecting structural columns.

2. Description of the Prior Art

Structural columns and poles are well known in the art, and throughout the years, a number of innovations have been developed relating to protecting such columns and poles. In this respect, the following U.S. patents are representative of a number of innovations for protecting columns or poles: U.S. Pat. No. 985,605; 1,244,119; 1,979,580; 3,738,072; and 5,371,986. More specifically, U.S. Pat. No. 985,605 discloses a pole protector used for round poles. The pole protector is secured to the pole by fasteners which penetrate into the pole. Clearly, such penetrating fasteners can do damage to the pole. To avoid such damage, it would be desirable if a pole protector were provided that is attached to a pole without the use of fasteners which penetrate into the pole.

U.S. Pat. No. 1,244,119 discloses a pole protector which includes two hemispherical, ground-penetrating segments which are secured to one another by sliding one hemispherical segment longitudinally against the other in a vertical direction. Such pole protectors are employed with tall outdoor poles, such as telephone poles, which are placed in holes in the ground. Such hemispherical segments could not be applied longitudinally to pole or column structures that are employed in building structures. In this respect, it would be desirable if a pole or column protector could be provided for poles or columns that are not installed in the ground.

U.S. Pat. No. 1,979,580 discloses a device for mounting a pole in the ground. As stated above, it would be desirable if a pole or column protector could be provided for poles or columns that are not installed in the ground.

U.S. Pat. No. 3,738,072 discloses a pole reinforcement device that is driven into the ground and that provides a stiff element for reinforcing the pole. It is noted that the still reinforcing element covers only a relatively small portion of the surface area of the pole. As a result, the reinforcing element protects only a small portion of the circumference of the pole from damage resulting from impacts or collisions with the pole. However, in certain instances, especially for a column in a building structure, it would be desirable if the entire circumference of such column could be protected from impacts or collisions with the column.

U.S. Pat. No. 5,371,986 discloses a pole repair and reinforcing system which employs reinforcing members which are secured to respective poles using fasteners which penetrate into the respective poles. As stated above, it would be desirable if a pole protector device could be provided without using fasteners which penetrate into the pole.

Still other features would be desirable in a column protector apparatus. In many structures, columns are provided which have right-angled corners. In this respect, it would be desirable if column protectors are provided for protecting right-angled corners.

In addition, in certain environments, such as in factories, electrical outlet boxes project outward from columns. In this respect, to protect such electrical outlet boxes from being bumped by forklifts and other factory equipment, it would be desirable if a column protector were provided that stands off from the column a further distance than an electrical outlet box projects.

The right-angled corners of columns present relatively sharp edges to any objects or persons who collide with the right-angled corners. To lessen the dangers of injury from such right-angled corners, it would be desirable if a column protector were provided which covers such right-angled corners and presents relatively flat surfaces to objects or persons who collide with protected right-angled corners.

Thus, while the foregoing body of prior art indicates it to be well known to use protectors for poles and columns, the prior art described above does not teach or suggest a column protector apparatus which has the following combination of desirable features: (1) does not use fasteners which penetrate into a pole or column; (2) protects poles or columns that are not installed in the ground; (3) protects the entire circumference of a pole or column from impacts or collisions with the pole or column; (4) protects right-angled corners of columns; (5) projects away from the column a further distance than an electrical outlet box projects; (and 6) presents relatively flat surfaces to objects or persons who collide with protected right-angled corners. The foregoing desired characteristics are provided by the unique column protector apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a protector apparatus for a vertical structure and includes a plurality of protector units for contacting the vertical structure, wherein each protector unit includes a structure-contacting portion, standoff portions projecting out from the structure-contacting portion, and a bumper portion supported by the standoff portions. Interconnectors are provided for connecting between the protector units for securing the protector units to each other and to the vertical structure. The interconnectors are connected between standoff portions of adjacent protector units. The standoff portions include bolt-reception channels, and the interconnectors include double-threaded-double-ended bolts. A single threaded end of each of the double-threaded-double-ended bolts is received in a bolt-reception channel, and the interconnectors include nuts secured to the single threaded bolt ends. When the nuts are tightened on the double-threaded-double-ended bolts, the protector units are connected tightly to each other. As a result, the protector units are secured to the column by virtue of the fact that the column is in effect tightly clamped between the protector units.

The vertical structure can include a circular outer surface and can be a pole. In addition, the vertical structure can include an outer surface that has right-angled corners and can be a column that includes right-angled corners.

For a four-corned column, the structure-contacting portion includes a first planar structure contacting portion and a second planar structure contacting portion connected to the first planar structure contacting portion at a right angle.

The standoff portions include a first standoff portion connected to the first planar structure contacting portion at a right angle and a second standoff portion connected to the second planar structure contacting portion at a right angle.

The bumper portion includes a first bumper segment connected to the first standoff portion at a right angle, a second bumper segment connected to the second standoff portion at a right angle, and a third bumper segment connected between the first bumper segment and the second bumper segment. The first bumper segment, the second bumper segment, and the third bumper segment are planar. Preferably, the third bumper segment is connected between each of the first bumper segment and the second bumper segment at an angle of approximately 135 degrees. Pad members can be sandwiched between the vertical structure and the structure-contacting portions. The pad members can be adhesively secured to the structure-contacting portion.

In accordance with another aspect of the invention, a kit is provided for protecting a vertical structure and includes a plurality of protector units. Each of which includes a structure-contacting portion, standoff portions projecting out from the structure-contacting portion, and a bumper portion supported by the standoff portions. Interconnectors are included in the kit for connection between the protector units for securing the protector units to the vertical structure and clamping the vertical structure therebetween. Preferably, the kit includes four protector units for protecting a four-cornered column.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved column protector apparatus which has all of the advantages of the prior art and none of the disadvantages.

It is another object of the present invention to provide a new and improved column protector apparatus which may be easily and efficiently manufactured and marketed.

It is a further object of the present invention to provide a new and improved column protector apparatus which is of durable and reliable construction.

An even further object of the present invention is to provide a new and improved column protector apparatus which is susceptible of a low cost of manufacture with regard to both materials and labor, and which accordingly is then susceptible of low prices of sale to the consuming public, thereby making such column protector apparatus available to the buying public.

Still yet a further object of the present invention is to provide a new and improved column protector apparatus which does not use fasteners which penetrate into a pole or column.

Still another object of the present invention is to provide a new and improved column protector apparatus that protects poles or columns that are not installed in the ground.

Yet another object of the present invention is to provide a new and improved column protector apparatus which protects the entire circumference of a pole or column from impacts or collisions with the pole or column.

Even another object of the present invention is to provide a new and improved column protector apparatus that protects right-angled corners of columns.

Still a further object of the present invention is to provide a new and improved column protector apparatus which projects away from the column a further distance than an electrical outlet box projects.

Yet another object of the present invention is to provide a new and improved column protector apparatus that presents relatively flat surfaces to objects or persons who collide with protected right-angled corners.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 3 is a perspective view of one of the corner protectors of the invention removed from the column.

FIG. 4 is an enlarged cross-sectional view of the corner protector shown in FIG. 3 taken along line 4—4 thereof.

DESCRIPTION OF THE PREFERRED EMBODIMENT

Figure 1:
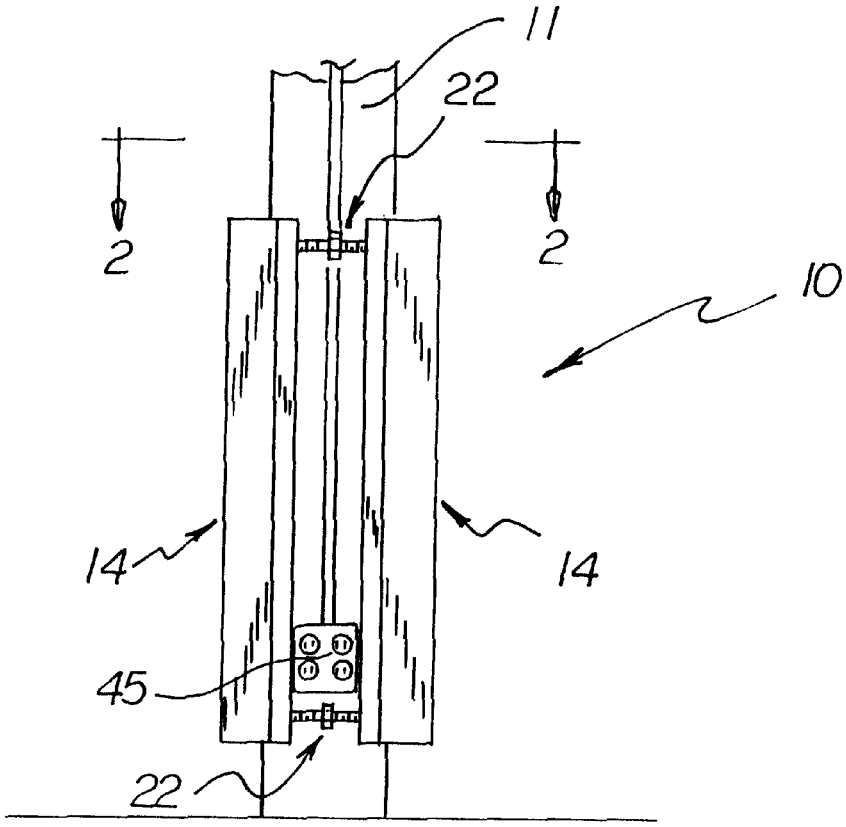
FIG. 1 is a side view showing a preferred embodiment of the column protector apparatus of the invention installed on a column that has right-angled corners.

With reference to the drawings, a new and improved column protector apparatus embodying the principles and concepts of the present invention will be described.

Turning to FIGS. 1–5, there is shown an exemplary embodiment of the column protector apparatus of the invention generally designated by reference numeral 10. In its preferred form, column protector apparatus 10 is provided for a vertical structure, such as a pole or column 11 and includes a plurality of protector units 14 for contacting the vertical structure, wherein each protector unit 14 includes a structure-contacting portion, standoff portions projecting out from the structure-contacting portion, and a bumper portion supported by the standoff portions. Interconnectors are provided for connecting between the protector units 14 for securing the protector units 14 to each other and to the vertical structure. The interconnectors are connected between standoff portions of adjacent protector units 14. The standoff portions include bolt-reception channels 20, and the interconnectors include double-threaded-double-ended bolts 22. A single threaded end of each of the double-threaded-double-ended bolts 22 is received in a bolt-reception channel 20, and the interconnectors include nuts 24 secured to the single threaded bolt ends. When the nuts 24 are tightened on the double-threaded-double-ended bolts 22, the protector units 14 are connected tightly to each other. As a result, the protector units 14 are secured to the column 11 by virtue of the fact that the column 11 is in effect tightly clamped between the protector units 14.

The vertical structure can include a circular outer surface and can be a pole. In addition, the vertical structure can include an outer surface that has right-angled corners 12 and can be a column 11 that includes right-angled corners.

For a four-corned column 11, the structure-contacting portion includes a first planar structure contacting portion 26 and a second planar structure contacting portion 28 connected to the first planar structure contacting portion 26 at a right angle.

The standoff portions include a first standoff portion 30 connected to the first planar structure contacting portion 26 at a right angle and a second standoff portion 32 connected to the second planar structure contacting portion 28 at a right angle.

The bumper portion includes a first bumper segment 40 connected to the first standoff portion 30 at a right angle, a second bumper segment 42 connected to the second standoff portion 32 at a right angle, and a third bumper segment 44 connected between the first bumper segment 40 and the second bumper segment 42. The first bumper segment 40, the second bumper segment 42, and the third bumper segment 44 are planar. Preferably, the third bumper segment 44 is connected between each of the first bumper segment 40 and the second bumper segment 42 at an angle 46 of approximately one hundred thirty-five degrees. In this way, the third bumper segment 44 provides a planar protective surface for the underlying right-angled corner of the column 11. Pad members 36 can be sandwiched between the vertical structure and the structure-contacting portions. The pad members 36 can be adhesively secured to the structure-contacting portion.

Figure 2:
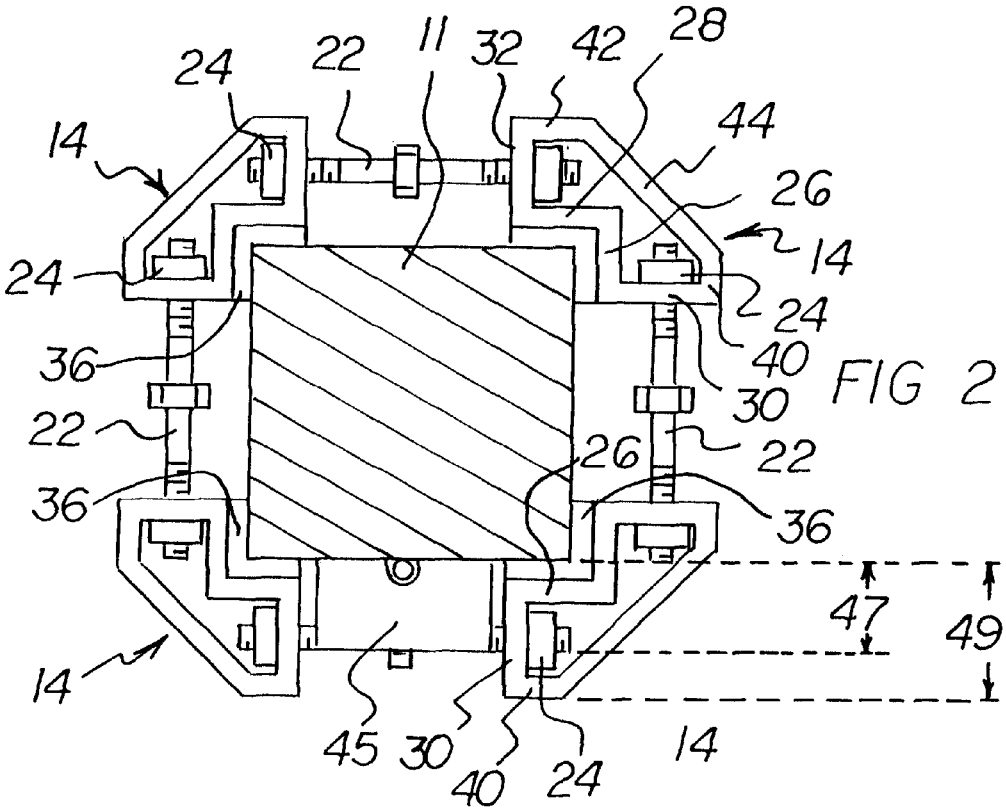
FIG. 2 is an enlarged cross-sectional view of the embodiment of the column protector apparatus shown in FIG. 1 taken along line 2—2 of FIG. 1.
Figure 5:
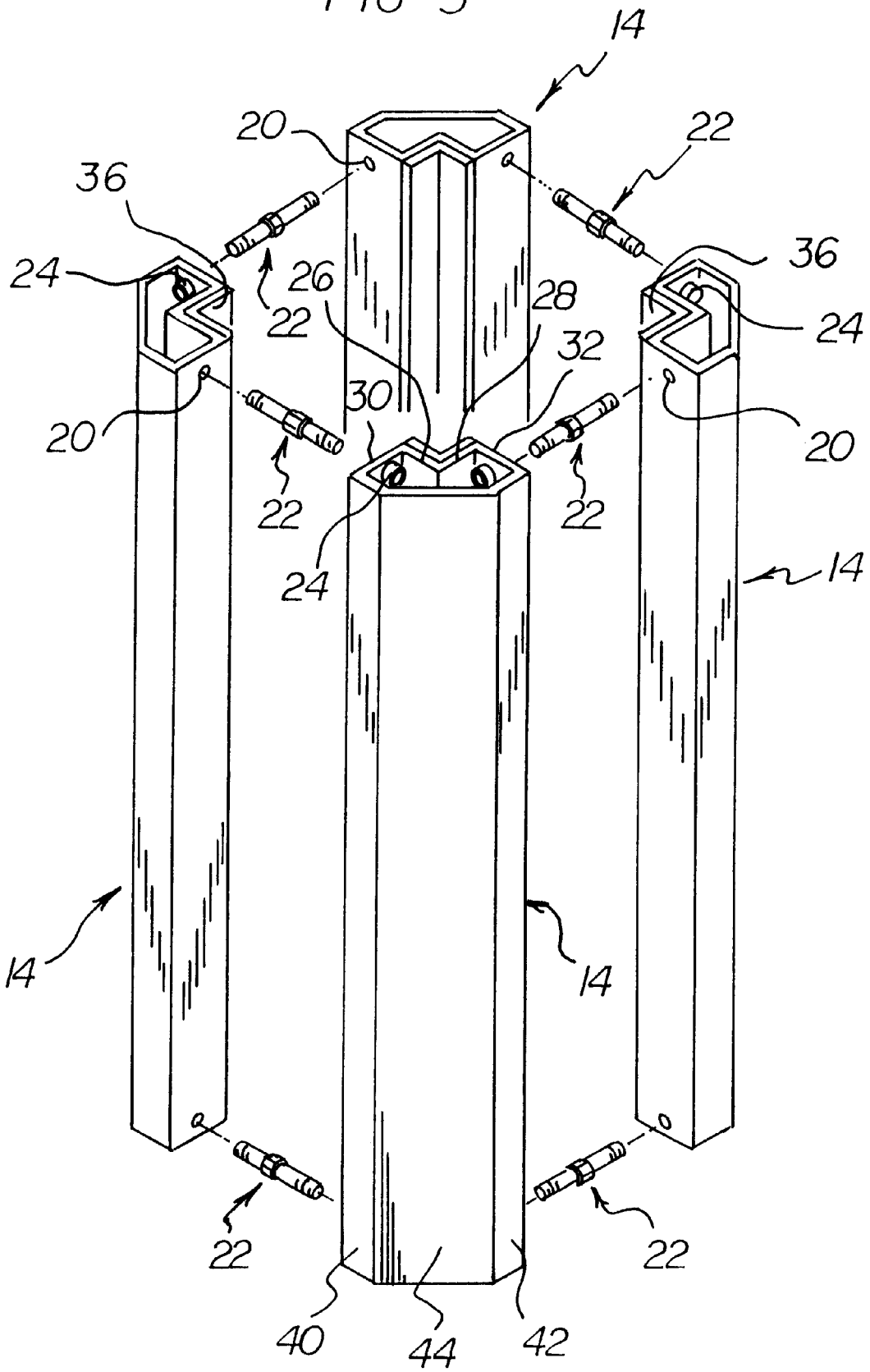
FIG. 5 is an exploded perspective view of the embodiment of the invention shown in FIG. 1 removed from the column.

To install the protector apparatus 10 of the invention on a column 11 which has right-angled corners such as shown in FIGS. 1 and 2, a single protector unit 14 is held in an installer's hand, and the pad member 36 is pressed over one of the right-angled corners. When this is done, one end of a double-threaded-double-ended bolt 22 is inserted through a bolt-reception channel 20, and a nut 24 is screwed onto the end of the installed double-threaded-double-ended bolt 22. Another double-threaded-double-ended bolt 22 is inserted through another bolt-reception channel 20, and another nut 24 is screwed onto the end of the other installed double-threaded-double-ended bolt 22. When the two double-threaded-double-ended bolts 22 have been installed in this way on one of the protector units 14, a second protector unit is place up against a second corner of the column 11. The free ends of the installed double-threaded-double-ended bolts 22 are passed through respective bolt-reception channels 20 in the second protector unit 14. Then, additional nuts 24 are applied to these free ends of the double-threaded-double-ended bolts 22. A similar procedure is followed to install the third and the fourth protector units 14 on third and the fourth right-angled corners of the column 11.

When the protector units 14, the double-threaded-double-ended bolts 22, and the nuts 24 are installed, the nuts 24 can be turned hand tight initially to get the protector units 14 to be retained on the column 11, by lightly clamping the column 11 between the protector units 14. However, to firmly secure the protector units 14 onto the column 11, the nuts 24 can be turned with a wrench. Once the nuts 24 have been tightened sufficiently, the protector units 14 are securely connected to one another and securely jacket and clamp the column 11 therebetween.

In addition, as can be seen in FIG. 2, an electrical outlet 45 projects outward an outlet distance 47 from the column 11. However, the cumulative thickness of thickness of the pad member 36, the thickness of the first planar structure contacting portion 26, the width of the first standoff portion 30, and the thickness of the first bumper segment 40 provides a standoff distance 49 which is greater than the outlet distance 47. As a result, the electrical outlet 45 is shielded from being bumped by objects by the protector units 14. The width of the first standoff portion 30 and the width of the second standoff portion 32 are the main factors contributing to the standoff distance 49.

In accordance with another aspect of the invention, a kit is provided for protecting a vertical structure and includes a plurality of protector units 14. Each of which includes a structure-contacting portion, standoff portions projecting out from the structure-contacting portion, and a bumper portion supported by the standoff portions. Interconnectors are included in the kit for connection between the protector units 14 for securing the protector units 14 to the vertical structure and clamping the vertical structure therebetween. Preferably, the kit includes four protector units 14 for protecting a four-cornered column.

The components of the column protector apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved column protector apparatus that is low in cost, relatively simple in design and operation, and which may advantageously be used to protect a pole or column without using fasteners which penetrate into the pole or column. With the invention, a column protector apparatus is provided which protects poles or columns that are not installed in the ground. With the invention, a column protector apparatus is provided which protects the entire circumference of a pole or column from impacts or collisions with the pole or column. With the invention, a column protector apparatus is provided which protects right-angled corners of columns. With the invention, a column protector apparatus is provided which projects away from the column a further distance than an electrical outlet box projects. With the invention, a column protector apparatus is provided which presents relatively flat surfaces to objects or persons who collide with protected right-angled corners.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A protector apparatus for a vertical structure, comprising:

a plurality of protector units for contacting the vertical structure, wherein each protector unit includes a structure-contacting portion, standoff portions projecting out from said structure-contacting portion, and a bumper portion supported by said standoff portions, interconnectors connected between said protector units for securing said protector units to the vertical structure, wherein said structure-contacting portion includes:

a first planar structure contacting portion, and a second planar structure contacting portion connected to said first planar structure contacting portion at a right angle.

2. The apparatus of claim 1 wherein:

said standoff portions include bolt-reception channels, and said interconnectors include double-threaded-double-ended bolts, wherein a single threaded end of each of said double-threaded-double-ended bolts is received in a bolt-reception channel, and wherein said interconnectors include nuts secured to said single threaded bolt ends.

3. The apparatus of claim 1 wherein said vertical structure includes an outer surface that has right-angled corners and is a column that includes right-angled corners.

4. The apparatus of claim 1 wherein a first standoff portion is connected to said first planar structure contacting portion at a right angle.

5. The apparatus of claim 4 wherein a second standoff portion is connected to said second planar structure contacting portion at a right angle.

6. The apparatus of claim 5 wherein said bumper portion includes:

a first bumper segment connected to said first standoff portion at a right angle, a second bumper segment connected to said second standoff portion at a right angle, and a third bumper segment connected between said first bumper segment and said second bumper segment.

7. The apparatus of claim 6 wherein said first bumper segment, said second bumper segment, and said third bumper segment are planar.

8. The apparatus of claim 7 wherein said third bumper segment is connected between each of said first bumper segment and said second bumper segment at an angle of approximately one hundred thirty-five degrees.

9. The apparatus of claim 1, further including:

pad members sandwiched between the vertical structure and said structure-contacting portions.

10. A kit for protecting a vertical structure, comprising:

a plurality of protector units, each of which includes a first planar structure contacting portion, and a second planar structure contacting portion connected to said first planar structure contacting portion at a right angle; standoff portions projecting out from each said structure-contacting portion, and a bumper portion supported by said standoff portions, and interconnectors for connection between said protector units for securing said protector units to the vertical structure.

11. The kit of claim 10 wherein four protector units are provided for protecting a four-cornered column.

* * * * *